United States Patent [19]

Murray

[11] Patent Number: 5,024,805

[45] Date of Patent: Jun. 18, 1991

[54] METHOD FOR DECONTAMINATING A PRESSURIZED WATER NUCLEAR REACTOR SYSTEM

[75] Inventor: Alexander P. Murray, Murrysville Boro, Pa.

[73] Assignee: Westinghouse Electric Corp., Pittsburgh, Pa.

[21] Appl. No.: 391,263

[22] Filed: Aug. 9, 1989

[51] Int. Cl.[5] ..... G21C 9/00

[52] U.S. Cl. ..... 376/305; 376/306; 376/313

[58] Field of Search ..... 376/305, 306, 313; 204/73 A, 74, 75, 78; 252/626; 134/4; 148/259; 106/456

[56] References Cited

U.S. PATENT DOCUMENTS

| | | | |
|---|---|---|---|
| 3,873,362 | 3/1975 | Mihram et al. | 134/3 |
| 4,325,744 | 4/1982 | Panayappan et al. | 134/4 |
| 4,537,666 | 8/1985 | Murray et al. | 204/129 |
| 4,587,043 | 5/1986 | Murray et al. | 252/626 |
| 4,670,066 | 6/1987 | Schapira et al. | 148/6.15 Z |
| 4,792,385 | 12/1988 | Snyder et al. | 204/140 |
| 4,828,790 | 5/1989 | Honda et al. | 376/306 |

OTHER PUBLICATIONS

An Assessment of Chemical Processes for the Postaccident Decontamination of Reactor Coolant Systems, NP-2866.

*Primary Examiner*—Brooks H. Hunt
*Assistant Examiner*—Meena Chelliah

[57] ABSTRACT

Metal surfaces having an oxide coating containing radioactive substances, such as the primary system of a pressurized water reactor, are decontaminated by passage thereover of a decontamination solution containing a weak chelating agent, such as nitrilotriacetic acid, and a ferrous salt, such as ferrous glutonate. The weak chelating agent is present in an aqueous solution in an amount of 0.1 to 2.0 percent by weight and the ferrous salt in an amount to provide 50 to 500 parts per million iron based on the weight of the solution. The solution, after contact with the metal surfaces is regenerated by an ion exchange resin or, preferably, by electrolysis.

13 Claims, No Drawings

METHOD FOR DECONTAMINATING A PRESSURIZED WATER NUCLEAR REACTOR SYSTEM

FIELD OF THE INVENTION

The present invention relates to a chemical method for decontaminating metal surfaces having an oxide coating containing radioactive substances, such as a pressurized water nuclear reactor system.

BACKGROUND OF THE INVENTION

The primary system surfaces of water-cooled nuclear reactors and equipment develop a corrosion product oxide ("rust") film during normal operation. The film incorporates radionuclides from the circulating coolant into its lattice, and becomes radioactive. This contributes to the out-of-core radiation fields, increases personnel radiation exposure, and hinders inspection and maintenance. Thus, effective decontamination has to substantially remove the oxide film, with minimal corrosion and metal substrate effects.

Oxide removal depends upon the film's structure, which is a function of the coolant chemistry and the metal substrate. For boiling water nuclear reactors (BWR's), "oxidizing" conditions prevail (0.5–0.2 ppm $O_2$), and the system alloys are 300 series stainless steels. These conditions result in a relatively thick, porous, hematite film, with iron as the predominant metal. Chromium is converted to chromates, and, hence, continually dissolves in the coolant. In contrast, pressurized water nuclear reactors (PWR's) operate with reducing water chemistry (<0.0005 ppm oxygen), and the primary system contains a large fraction of high nickel alloys. These conditions produce a denser, more coherent and tenacious oxide film, containing chromium in a nickel ferrite lattice. Thus, BWR films are easier to dissolve and remove than PWR films; the latter usually require an oxidation treatment for chromium removal before the film can be dissolved. For either case, iron represents the dominant metal species in solution after film removal.

Commercially available decontamination solutions generally fall into three categories. These are the Citrox solutions, Can-Decon solutions and Low Oxidation State Metal Ion (LOMI) solutions such as are described in the processes discussed in "An Assessment of Chemical Processes for the Postaccident Decontamination of Reactor Coolant Systems" EPRI Report NP-2866 of February 1983. The first solution uses organic acid species only, such as the Citrox-like solutions, which contain organic acids that remove the oxide film by both dissolution and spallation mechanisms. Citric and oxalic acids are the usual components. These solutions are effective and ion exchange well, but produce particulates and have precipitated iron during plant applications. A second solution uses a chelant solution, such as the Can-Decon-like solutions which use chelants to avoid precipitation and reduce the particulate generation. However, the chelants usually depress the ion exchange parameters. A third solution is an LOMI solution which uses vanadium (II) in a picolinic/formic acid buffer. The vanadium (II) acts as a reductive dissolution agent on the oxide, and particulate generation is minimized. The principal drawbacks of these solutions are the inability to cation exchange the solution and the fact that vanadium can exist in multiple valence states.

As the oxide film dissolves, ferric iron (III) accumulates in solution. Iron (III) can induce base metal corrosion, intergranular attack (IGA) and intergranular stress crack corrosion (IGSCC); it can also behave as an oxidizing-type inhibitor and limit corrosion. For Citrox-like solutions, above 25 to 30 parts per million (ppm) of iron results in increased corrosion with IGA and IGSCC tendencies. The chelants in Can-Decon solutions form strong complexes with iron (III). Therefore, three behavorial regimes can be observed: (a) at 0 to 25 ppm iron (III), free corrosion with increased IGA-/IGSCC tendencies, (b) at 25 to 130 ppm iron (III), reduced corrosion and IGSCC tendencies, but IGA may still occur; and (c) above approximately 130 ppm iron (III), Citrox-like behavior with increased corrosion. The dissolved iron (III) also depresses the dissolution kinetics The LOMI process removes the iron in the reduced, divalent state, and iron corrosion effects are minimized. However, after four to eight hours, the vanadium exists as the quadravalent species, and the solution behaves like an iron-containing Citrox solution.

Entire primary system decontamination is expected to result in dissolved iron concentrations of 100 to 200 ppm and last for about 20 to 96 hours. Thus, significant and deleterions iron (III)/metal effects upon corrosion, ion exchange and kinetics can be expected.

SUMMARY OF THE INVENTION

A method of decontaminating metal surfaces having an oxide coating containing radioactive substances, such as the primary system of a pressurized water nuclear reactor, uses an aqueous decontamination solution containing a weak chelating agent and a ferrous salt of an organic acid. The weak chelating agent is capable of forming multiligand complexes with the metals from which the oxide coating is formed, and is present in an amount of between 0.1 and 2.0 percent based on the weight of the solution. The ferrous salt is present in an amount to provide 50 to 500 parts per million iron based on the weight of the solution.

The decontamination solution is passed over the metal surfaces to remove the oxide coating therefrom.

The decontamination solution is regenerated by passing at least a portion thereof, after contact with the metal surfaces, through a cation exchange resin column or, preferably, through an electrolysis unit.

DETAILED DESCRIPTION

The present method for decontaminating metal surfaces having an oxide coating containing radioactive substances, such as the primary system surfaces of a pressurized water nuclear reactor, uses an aqueous solution of weak chelants and iron (II) or ferrous iron. The weak chelant maintains the dissolved metals in solution and prevents precipitation, while the ferrous iron improves the dissolution rate and minimizes base metal corrosion.

The radioactive metals that are to be removed in a pressurized water reactor primary system include ferric iron ($Fe^{III}$), nickel, chromiun, cobalt and manganese, which are metals forming the primary system components. The process uses an aqueous decontamination solution containing a weak chelant, capable of forming multiligand complexes with the metals of the oxide coating, in an amount of between 0.1 to 2.0 percent by weight based on the weight of the solution. The weak chelants are complexing agents generally having an equilibrium constant for metal ions, such as ferric ions, of between about $10^{12}$ to $10^{19}$. Examples of such chelants are nitrilotriacetic acid (NTA), hydroxyethylenediamine tetraacetic acid (HEDTA), citric acid, and iminodiacetic acid (IDA), with NTA being preferred because of its high iron capacity, multiligand ability, and relatively low complexation constant. Preferably, the concentration of the chelant is about 0.2 percent based on the weight of the aqueous solution. The use of less than about 0.1 percent chelant will not keep the ions in solution and chelate ions removed from the surface, while more than about 2.0 percent is inefficient and unnecessary.

In addition to the weak chelant, the aqueous solution contains an organic ferrous salt in an amount to provide a ferrous iron ($Fe^{II}$) concentration of between about 50 to 500 parts per million (ppm) based on the weight of solution. If less than about 50 ppm ferrous iron is present, the decontamination will not be effected, while more than about 500 ppm is inefficient and wasteful. Preferably about 100 ppm of ferrous iron of such an organic ferrous salt is used. These salts are ferrous salts of polyfunctional organic acids that are compatible with the materials of the primary system during operation of the pressurized water nuclear reactor. Organic acids are required to form the ferrous salts because inorganic acids can leave residual ions that can cause corrosion problems in the reactor during subsequent operations, whereas organic acids decompose to produce water and carbon dioxide. Such ferrous salts include ferrous acetate, ferrous oxalate, and ferrous gluconate. While the latter two ferrous salts are relatively insoluble in water, the same will dissolve in dilute chelant solutions.

The ferrous iron ($Fe^{II}$), with NTA, provides for reduction dissolution of the metal oxide with rapid kinetics (equations 1 and 2):

$$Fe^{+2}_{(aq)} + Fe^{+3}_{(oxide)} = Fe^{+3}_{(aq)} + Fe^{+2}_{(oxide)} \quad (1)$$

$$Fe^{+2}_{(oxide)} + H_3NTA_{(aq)} = (FeNTA)^{-1}_{(aq)} + 3H^{+}_{(aq)} \quad (2)$$

Multiple ligand complexes can then form. Corrosion of the base metal is inhibited by reactions such as equation 3, as compared to equation 4 for ferric ion corrosion:

$$Fe^{+2}_{(aq)} + Fe^{o}_{(metal)} = \text{no reaction} \quad (3)$$

$$2Fe^{+3}_{(aq)} + Fe^{o}_{(metal)} = 3Fe^{+2}_{(aq)} \quad (4)$$

The presence of a relatively large concentration of ferrous iron ($Fe^{II}$) shifts the equilibrium and also inhibits ferric iron ($Fe^{III}$) corrosion by equation 4.

Additional ferrous iron is provided during decontamination. During the decontamination, the metal oxide film dissolves, and iron is present generally as ferric iron ($Fe^{III}$). This can be reduced in a sidestream, electrolytic reactor using porous electrodes, as described in U.S. Pat. No. 4,537,666, assigned to the assignee of the present invention and incorporated by reference herein, i.e.:

$$Fe_{(aq)}{}^{+3} \xrightarrow{+1e^-} Fe_{(aq)}{}^{+2} \xrightarrow{+2e^-} Fe_{(s)}{}^{o} \quad (5)$$

The electrolytic approach is effective for concentrated solutions (say 1 wt %), and will provide for a gradual buildup of ferrous iron ($Fe^{II}$). However, entire loop decontamination will use dilute solutions, and will require a consistent ferrous iron ($Fe^{II}$) presence throughout the application for corrosion and kinetic purposes.

After passing the decontamination solution over the metal surface to remove radioactive substances therefor, the solution is regenerated and returned for further contact with those surfaces. Regeneration may be effected by treating a portion or sidestream thereof, either by use of cation exchange resins or electrolytically. The use of cation exchange resins to remove contaminants and recover reagents for reuse in decontamination methods is known. Solution regeneration by cation exchange is somewhat complicated, here, however, as ferrous iron ($Fe^{II}$) complexes are more readily removed than ferric iron ($Fe^{III}$) complexes. It is thus advisable to valve in an ion exchange column after the method has been running for a period of time, e.g. two hours. Electrolytic regeneration is the preferred regeneration method since it preferentially reduces the ferric iron ($Fe^{III}$), albeit at a reduced efficiency in the dilute solution. Such electrolytic regeneration, as described in U.S. Pat. No. 4,537,666, passes the decontamination solution through a permeable electrode formed by a stainless steel wire or copper mesh in order to plate out the ions. When the electrode becomes spent, it is replaced. Or, as described in U.S. Pat. No. 4,792,385, assigned to the assignee of the present invention, the contents of which are incorporated herein, the permeable electrode may be comprised of a bed of carbon, or graphite particles, or an electrically conductive plastic material such as polyacetylene. Regardless of the method of regeneration used, however, slipsream regeneration of a large pressurized water reactor will have a long time constant, such as approximately 6 hours, and thus, will be incomplete. The time for decontamination of a pressurized water invention system using a present process would be expected to be in a range of about 6 to 24 hours.

The temperature of the decontamination solution does not need adjustment and will typically be at a temperature of 70° C. to 150° C. during the decontamination method. The present process thus provides a chemical method for decontaminating pressurized water nuclear reactor systems utilizing a ferrous salt in the decontamination solution with the benefits described herein.

What is claimed is:

1. The method of decontaminating metal surfaces having an oxide coating containing radioactive substances comprising:

providing an aqueous decontamination solution which comprises an aqueous solution of a weak chelating agent capable of forming multiligand complexes with metals, said chelating agent present in an amount of between about 0.1 to 2.0 percent based on the weight of the solution, and a ferrous salt in an amount to provide 50 to 500 parts per million iron based on the weight of the solution; and passing said decontamination solution over the metal surfaces.

2. The method as defined in claim 1 wherein said weak chelating agent is selected from the group consisting of nitrilotriacetic acid, hydroxyethylenediamine tetraacetic acid, citric acid, and iminodiacetic acid.

3. The method as defined in claim 1 wherein said ferrous salt is selected from the group consisting of ferrous acetate, ferrous oxalate and ferrous glutonate.

4. The method as defined in claim 1 wherein said weak chelating agent is nitrilotriacetic acid and is present in an amount of about 0.2 percent, and said ferrous salt is ferrous glutonate and is present in an amount to provide about 100 ppm iron.

5. The method as defined in claim 1 wherein said decontamination solution, after contact with said metal surfaces is regenerated and returned for further passing over the metal surfaces.

6. The method as defined in claim 5 wherein said decontamination solution is regenerated by passage thereof over a cation exchange resin.

7. The method as defined in claim 5 wherein said decontamination solution is regenerated by passage thereof through a permeable electrode.

8. The method of decontaminating metal surfaces having an oxide coating containing radioactive substances comprising:

providing an aqueous decontamination solution which comprises an aqueous solution of a weak chelating agent selected from the group consisting of nitrilotriacetic acid, hydroxyethylenediamine tetraacetic acid, citric acid, and iminodiacetic acid, said chelating agent present in an amount of between about 0.1 to 2.0 percent based on the weight of the solution, and a ferrous salt, selected from the group consisting of ferrous acetate, ferrous oxalate and ferrous glutonate, in an amount to provide 50 to 500 parts per million iron based on the weight of the solution; and passing said decontamination solution over the metal surfaces; and after contact with said metal surfaces, regenerating said solution by passage thereof through a permeable electrode, and returning the regenerated solution for further passing over the metal surfaces.

9. A method of dissolving radioactive corrosion products from the internal metallic surfaces of a pressurized water nuclear reactor comprising:

providing an aqueous decontamination solution which comprises an aqueous solution of a weak chelating agent capable of forming multiligand complexes with metals of said metallic surfaces, said chelating agent present in an amount of between about 0.1 to 2.0 percent based on the weight of the solution, and a ferrous salt in an amount to provide 50 to 500 parts per million iron based on the weight of the solution;

passing said decontamination solution over said metallic surfaces.

10. The method as defined in claim 9 wherein said weak chelating agent is selected from the group consisting of nitrilotriacetic acid, hydroxyethylenediamine tetraacetic acid, citric acid, and iminodiacetic acid, and said ferrous salt is selected from the group consisting of ferrous acetate, ferrous oxalate and ferrous glutonate.

11. The method as defined in claim 10 wherein said decontamination solution, after contact with said metal surfaces is regenerated and returned for further passing over the metal surfaces.

12. The method as defined in claim 11 wherein said decontamination solution is regenerated by passage thereof over a cation exchange resin.

13. The method as defined in claim 11 wherein said decontamination solution is regenerated by passage thereof through a permeable electrode.

* * * * *